United States Patent [19]

Cuvelier et al.

[11] 4,212,429

[45] Jul. 15, 1980

[54] METHOD AND AN APPARATUS FOR CONTROLLING A CRUSHER

[75] Inventors: Jean-Philippe Cuvelier, Castres; Henri Gistau, Paris, both of France

[73] Assignee: Societe Miniere et Metallurgique de Penarroya, Paris, France

[21] Appl. No.: 886,831

[22] Filed: Mar. 15, 1978

[30] Foreign Application Priority Data

Mar. 16, 1977 [FR] France ..... 77 07810

[51] Int. Cl.[2] ..... B02C 17/18; B02C 25/00

[52] U.S. Cl. ..... 241/26; 241/30; 241/36

[58] Field of Search ..... 318/332, 432, 433, 317; 241/26, 27, 30, 33, 34, 35, 36

[56] References Cited

U.S. PATENT DOCUMENTS

| | | | |
|---|---|---|---|
| 2,613,878 | 10/1952 | Hailey | 241/35 |
| 3,181,800 | 5/1965 | Noren et al. | 241/36 X |
| 3,264,881 | 8/1966 | Poklar et al. | 318/432 X |
| 3,510,743 | 5/1970 | Mortimer | 318/432 X |

*Primary Examiner*—Mark Rosenbaum

*Attorney, Agent, or Firm*—Fleit & Jacobson

[57] ABSTRACT

A method and apparatus for controlling an autogenous or semiautogenous crusher, in which the quantity of charge within the crusher is determined continuously. The speed of rotation of the crusher is controlled in accordance with a function which links the speed of rotation of the crusher to the quantity of the charge in the crusher. In a preferred embodiment, the charge is determined from the resistance experienced by the motor which drives the crusher. This resistance is a linear function of the charge within the crusher. The control apparatus provides an electrical signal which is proportional to the quantity of charge and the electrical signal is then used to control the speed of rotation of the crusher.

8 Claims, 2 Drawing Figures

METHOD AND AN APPARATUS FOR CONTROLLING A CRUSHER

Figure 1:
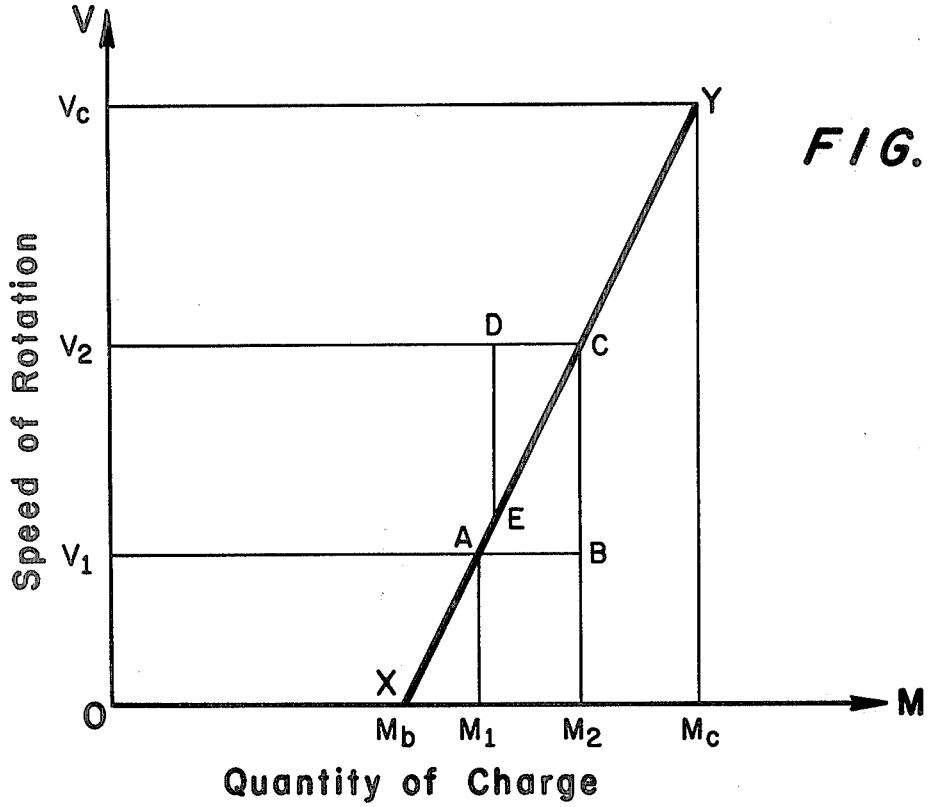

The present invention relates to a method and an apparatus for controlling crushers, in particular ore crushers of the kind sometimes referred to as "semi-autogenous."

One known kind of ore crusher comprises a cylinder provided with internal fins and revolving on its longitudinal axis which is substantially horizontal. The ore is fed into the crusher through an opening at one end of the cylinder and passes through the cylinder to the opposite end where the crushed ore is discharged. In the crusher, the ore is lifted constantly by the fins and falls repeatedly to break up by virtue of its own weight, and crushers of this kind are referred to as "autogenous crushers."

To improve the crushing action, a particular quantity of metal balls is often placed in the cylinder, the balls falling onto the ore which is to be crushed, after they too have been lifted by the fins, to cause a greater disintegration of the ore as compared with that obtained in autogenous crushing. It is to be noted that the charge of balls inserted into a crusher of this nature is considerably smaller than that which is the rule in a ball crusher or mill, which explains the name "semi-autogenous crusher" applied to ore crushers of this kind.

In the use of such semi-autogenous crushers, the filling rate, which should fluctuate as little as possible, is a factor which should be taken into maximum account. Reference is frequently made to "total charge," or more simply to "charge," instead of to "filling rate"; the term "total charge" means the sum of the charge of balls, which is constant, and the charge of ore which is liable to vary. If the total charge decreases, that is to say if the quantity of ore contained in the crusher diminishes or even drops to zero, the impact of the metal balls on the side wall of the revolving cylinder raises the risk of damaging the lining of the cylinder, with all the disadvantages and expense entailed; moreover, if the ore is soft, the conveying system may no longer be adequate to assure the removal of the product. Conversely, if the total charge increases excessively, packing or ramming problems may arise, particularly if the ore is hard; the quantity of the charge beyond which this action occurs is referred to as the "critical charge."

Various solutions have been proposed for keeping a more or less constant charge in crushers of this nature. These solutions are based on attempts to maintain a constant charge whilst the crusher turns at a constant speed close to its critical speed, which is the speed at which a centrifuging action on the charge starts to occur. Consequently, it is sought to measure the changes of the charge within the crusher, with a view to controlling the rate of flow of the incoming ore. One widely applied method for determining these variations has recourse to the noise generated by the crusher in rotation. It has been observed that when an increasingly harsh noise is emitted, the charge increasingly tends to consist of metal balls only, which may lead rapidly to damage to the lining of the side wall of the crusher, as mentioned above. In contrast, when the noise emitted by the crusher becomes dull, this denotes that the charge is closely approaching or has exceeded the critical charge; this may lead to clogging at the inlet of the crusher and, on occasion, to unsatisfactory crushing of the ore. Two means are principally applied for detecting the variations of the noise emitted by the rotating crusher; these are the human ear, which requires sustained attention within a noisy environment, and an electronic "ear" which may lack reliability.

Thus, like all those based on influencing the charge rate, the above-described method does not provide wholly satisfactory control, and there is too high a risk of damaging the crusher and/or clogging its intake. A frequent result is the inability to operate the crusher at optimum output and thus operators tend to provide downstream of the crusher, equipment which is oversized with respect to the real capacity of the crusher.

Another method of controlling the rate of charge is based on the weight of the crusher, this weight being measured either directly or indirectly. For example, the weight of the charge may be determined by mounting the crusher on balances, or by determining the oil pressure in the crusher bearings. These solutions have the major disadvantage that determination of the charge from the weight of the crusher while in operation is too inaccurate to render it possible to secure effective control.

It is an object of the present invention to provide a method and an apparatus for controlling autogenous and semiautogenous crushers which results in obtaining substantially constant rates of flow of crushed ore at the outlets of the crushers.

Another object of the invention is to provide a method and an apparatus for controlling autogenous and semi-autogenous crushers which render it possible to reduce the cost of the plant and of the treatment of ores, and also to increase the working lives of the internal linings of the crusher cylinders.

In accordance with the present invention, there is provided a method of controlling an autogenous or a semi-autogenous crusher, in which the quantity of charge (M) within the crusher is determined continuously, and the speed of rotation (V) of the crusher is controlled in accordance with a function which links said speed of rotation to said quantity of charge.

Advantageously, the charge is determined from the resistance (C) experienced by a motor driving the crusher. More specifically, it has now been demonstrated that this resistance is a linear function of the charge present within the crusher. On the other hand, it is known that the resistance is proportional to the power (P) absorbed by the motor and inversely proportional to the speed of rotation of the crusher. The result is that the charge (M) is proportional to the ratio P/V.

The positive linking function which couples the speed of rotation (V) with the charge (M) preferably has the following form:

$$V=aM+b.$$

The constants a and b depend on the crusher itself on the one hand, and in particular on the material lining the cylindrical side wall of the crusher, and, on the other hand, on the crushing method.

Suitably, the speed of rotation (V) of the crusher equals the critical speed ($V_c$) when the quantity of charge (M) is equal to the critical charge ($M_c$), and is zero when the quantity of charge is equal to the charge of balls; that is to say when there is no more ore present in a semi-autogenous crusher or, in the case of autogenous crushing when the quantity of charge becomes equal to a preset value which, for example, is half the critical charge.

Those skilled in the art will readily appreciate that this control action is performed in open circuit, and not in a closed circuit where a rated value would have to be set up.

The control apparatus in accordance with the present invention comprises means for providing an electrical input signal proportional to said quantity of charge; means for converting the input signal into an output signal derived from said input signal in accordance with said function; and means for controlling the speed of rotation of said crusher in proportion to the value of said output signal.

The means for providing an input signal proportional to the charge preferably comprise a device for measuring the power absorbed by driving means for the crusher, a device for measuring the speed of rotation of the crusher, and means for producing a signal which is proportional to said power absorbed and inversely proportional to said speed of rotation.

In the case where the crusher is driven by an electric motor, the absorbed power (P) is determined from the current (I) passing through the motor and the voltage (U) across the terminals of this motor, by the conventional formula:

$$P = kUI \cos \text{phi}.$$

If the motor has a direct current supply, this formula is simplified and becomes:

$$P = UI.$$

If the motor has a three-phase alternating current supply, the coefficient k is equal to $\sqrt{3}$.

Preferably, the control apparatus in accordance with the invention further comprises at least one safety system to prevent said quantity of charge from exceeding the critical charge.

Suitably, the safety system comprises means for comparing said quantity of charge with the critical charge of the crusher, and triggering means to operate when said quantity of charge becomes equal to a predetermined proportion of said critical charge.

Preferably, the safety system also comprises means for acting on the rate of flow at the intake of the crusher upon operation of said triggering means. The quantity of charge thus can never exceed the critical charge, even if, taking the nature of the ore into account, ore were to be fed into the crusher in such quantity that the plant could not process the ore sufficiently quickly.

To mitigate the consequences of transients which could occur in the circuits, the control device may comprise one or more filters.

Systematic study of the resistance (C) of a crusher on its driving motor has shown that, for a given charge, the resistance remains constant notwithstanding the speed of rotation. Morever, when the charge varies, the resistance varies in proportion to the charge. In accordance with the conventional laws of physics, it can be deduced that the charge (M) is proportional to the power (P) absorbed by the motor and inversely proportional to the speed or rotation (V) of the crusher.

According to the present invention it has been discovered that a control method wherein action is taken on the speed of rotation of the crusher and not on the quantity of ore entering the crusher, whilst accepting variations of the charge between predetermined values, yields highly satisfactory results.

Figure 2:
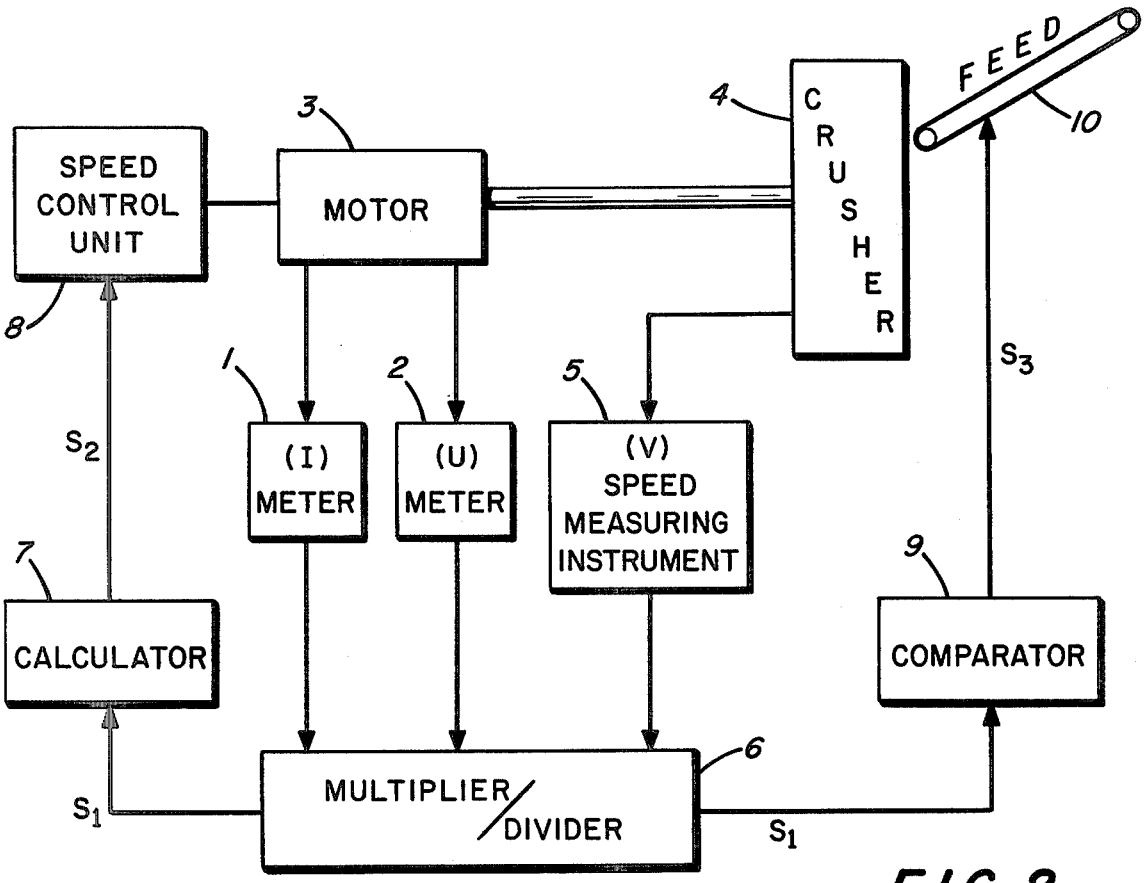

An embodiment of the present invention will now be described, by way of example, with reference to the accompanying drawings in which:

FIG. 1 is a graph illustrating the variations of the speed of rotation of a crusher as a function of its charge; and, FIG. 2 is a block diagram illustrating the control apparatus of the invention.

In FIG. 1 a line XY has been plotted which illustrates the variation of the speed of rotation (V) of the crusher cylinder as a function of the quantity of charge (M). The speed is zero when the charge is equal to a preset charge which is the charge of balls ($M_b$), and the charge ($M_b$) may be equal to half the critical charge ($M_c$). The speed is equal to the critical speed ($V_c$) when the charge is equal to the critical charge ($M_c$).

The measured speed of rotation is ($V_1$) for a charge ($M_1$). If this charge increases to ($M_2$), the measured speed will remain equal to ($V_1$) during a first stage, as represented by the line AB in FIG. 1.

During the period represented by the line AB, the function $V = aM + b$ renders it possible to determine the desired new speed of rotation ($V_2$) of the crusher following this increase in charge; this is represented by the line BC in FIG. 1. The new point (C) of the operation is determined in this manner.

In the case where the charge decreases, the graphical representation is analogous to but opposed in direction to that described above; the relevant representation comprises the lines CD and DE in FIG. 1.

It will be understood that a control method of this kind, performed in open circuit, renders it possible to maintain the rates of flow of ore at the intake and outlet of the crusher at substantially constant values.

For example, in one particular case, a semi-autogenous crusher has a cylinder diameter of 4.20 meters, and the cylinder is provided with a metal lining. In this case, the constant a is equal to 2, the charge of balls being half the critical charge. In these circumstances, the linking function is:

$$V = 2M - 1.$$

The constant a may be raised to 3 if the metal lining is replaced by a rubber lining.

A control apparatus which also forms a feature of the invention, is illustrated diagrammatically in FIG. 2. The apparatus comprises, in the case where a crusher 4 is driven by an electric motor 3, a meter 1 for measuring the current (I), and a meter 2 for measuring the voltage (U) supplied to the feed circuit of the motor 3. An instrument 5 measures the speed of rotation (V) of the crusher 4, and a multiplier-divider 6 delivers at its output side a signal ($S_1$) proportional to the charge (M) which is itself proportional to the ratio UI/V, as stated above.

The multiplier-divider 6 is connected to a calculator 7 or functional section which provides an output signal ($S_2$) determined from the input signal ($S_1$) by means of the formula:

$$V = aM + b.$$

The output signal ($S_2$) is finally transmitted to a unit 8 which controls the speed of the motor 3, as has been stated above.

A filter is preferably installed between the multiplier-divider 6 and the calculator 7 to attenuate the effects of transients and interferences which could impair the satisfactory operation of the apparatus.

So that the quantity of charge within the crusher may never exceed the critical charge, a safety system is incorporated. The output signal ($S_1$) of the multiplier-divider 6 is then also transmitted to a comparator 9. If this signal ($S_1$) shows that the charge exceeds a particular value ($M_a$) close to the critical charge ($M_c$), the value ($M_a$) being equal to say 95% of the critical charge, the comparator 9 delivers an output signal ($S_3$) which is transmitted to feed mechanisms 10 of the crusher. Using conventional control equipment, this results in a reduction of the rate of flow of ore at the intake of the crusher 4.

A series of two or three comparators may be incorporated, each having a different charge rating, which renders it possible to prevent too rapid a change of the rate of flow of ore at the intake of the crusher 4.

No deviation from the concept of the present invention will be made by connecting the instrument 5 for measuring the speed of rotation directly to the motor 3, which results in measuring a quantity proportional to the speed of rotation of the crusher 4.

On the other hand, it is possible to measure the resistance to rotation of the motor 3 by other methods, for example by resorting to strain gauges.

Although an ore is the only material to be treated mentioned in the preceding description, the method and the apparatus in accordance with the invention may be employed for crushing materials of other kinds.

We claim:

1. A method for controlling an autogenous or a semi-autogenous crusher, in which the charge within the crusher is continously determined, and the speed of rotation of said crusher is controlled in accordance with a function which links said speed of rotation to said charge and in which said charge is determined from a resistance to rotation experienced by a motor which drives said crusher, and in which said resistance is determined by the ratio between the power absorbed by said motor and the speed of rotation of said crusher.

2. A method according to claim 1, in which the speed of rotation of the crusher is equal to the critical speed of the crusher when said charge is equal to the critical charge, and in which said speed of rotation is zero when said charge is equal to half the critical charge.

3. A method for controlling an autogenous or a semi-autogenous crusher, in which the charge (M) within the crusher is continuously determined from the resistance to rotation experienced by a motor which drives said crusher, and the speed of rotation (V) of said crusher is controlled in accordance with a function which links said speed of rotation (V) to said charge (M) and which has the form: $V=a.M+b$, wherein a and b are constants respectively depending on the crusher structure and the crushing method, wherein said resistance is determined by the ratio between the power utilized by said motor and the speed of rotation of said crusher.

4. A method according to claim 3, in which the speed of rotation of the crusher is equal to the critical speed of the crusher when said charge is equal to the critical charge, and in which said speed of rotation is zero when said charge is equal to half the critical charge.

5. An apparatus for an autogenous or a semi-autogenous crusher comprising means for providing an electric signal proportional to the charge within the crusher; means for converting this input signal into an output signal derived from said input signal in accordance with a function which links the speed of rotation of said crusher to said charge; and means for controlling said speed of rotation of said crusher in proportion to the value of said output signal, in which said means for providing an input signal comprise a device for measuring the power absorbed by driving means for the crusher, a device for measuring the speed of rotation of the crusher, and means for producing a signal which is proportional to said power absorbed and inversely proportional to said speed of rotation.

6. An apparatus for an autogenous or a semi-autogenous crusher comprising means for providing an electrical input signal proportional to the quantity of charge within the crusher; means for converting the input signal into an output signal derived from said input signal in accordance with a function relating the speed of rotation of the crusher to the quantity of charge in the crusher; means for controlling the speed of rotation of said crusher in proportion to the value of said output signal; and at least one safety system to prevent said quantity of charge from exceeding the critical charge of the crusher, in which said means for providing an input signal comprise a device for measuring the power absorbed by driving means for the crusher, a device for measuring the speed of rotation of the crusher, and means for producing a signal which is proportional to said power absorbed and inversely proportional to said speed of rotation.

7. An apparatus according to claim 6, in which said safety system comprises means for comparing said quantity of charge with the critical charge of the crusher, and triggering means to operate when said quantity of charge becomes equal to a predetermined proportion of said critical charge.

8. An apparatus according to claim 7, in which said safety system further comprises means for acting on the rate of flow at the intake of the crusher upon operation of said triggering means.

* * * * *